US011109689B1

(12) United States Patent
Heisey et al.

(10) Patent No.: US 11,109,689 B1
(45) Date of Patent: Sep. 7, 2021

(54) INFANT REPOSITIONING DEVICE

(71) Applicant: Hyco Holdings, LLC, Colleyville, TX (US)

(72) Inventors: Emily Claire Heisey, Colleyville, TX (US); Brandon Gerald Corse, Colleyville, TX (US)

(73) Assignee: Hyco Holdings, LLC, Colleyville, TX (US)

( * ) Notice: Subject to any disclaimer, the term of this patent is extended or adjusted under 35 U.S.C. 154(b) by 0 days.

(21) Appl. No.: 17/069,730

(22) Filed: Oct. 13, 2020

(51) Int. Cl.

| | |
|---|---|
| ***A47D 7/01*** | (2006.01) |
| ***A47D 13/08*** | (2006.01) |
| ***A47D 15/00*** | (2006.01) |
| *A47D 9/00* | (2006.01) |
| *A47D 7/00* | (2006.01) |

(52) U.S. Cl.
CPC ..... *A47D 7/01* (2013.01); *A47D 13/08* (2013.01); *A47D 15/005* (2013.01); *A47D 15/008* (2013.01); *A47D 7/002* (2013.01); *A47D 9/005* (2013.01); *A47D 15/003* (2013.01)

(58) Field of Classification Search
CPC . A47D 7/01; A47D 7/00; A47D 13/00; A47D 13/08; A47D 15/005; A47D 15/008; A47D 15/00; A47C 20/027; A47C 20/02; A47C 20/00; A47C 7/40; A47C 7/36; A47G 9/109; A47G 9/10; A47G 9/02
USPC ..... 5/655, 652, 633, 632, 485
See application file for complete search history.

(56) References Cited

U.S. PATENT DOCUMENTS

| | | | | |
|---|---|---|---|---|
| 2,404,505 | A * | 7/1946 | Knecht | A47D 15/006 297/467 |
| 3,485,241 | A * | 12/1969 | Polley | A41D 10/00 128/871 |
| 5,263,496 | A * | 11/1993 | Cherniak | A61F 5/03 128/876 |
| 5,331,699 | A * | 7/1994 | Patton | A47D 13/08 128/876 |
| 5,347,669 | A * | 9/1994 | Neviaser | A47D 13/08 5/630 |
| 5,450,640 | A * | 9/1995 | Patton | A47D 15/008 5/655 |
| 5,953,749 | A * | 9/1999 | Backs | A47C 20/025 2/1 |
| 6,711,770 | B1 * | 3/2004 | Owens | A47D 13/083 5/655 |
| 6,842,925 | B1 * | 1/2005 | Owens | A47D 13/083 5/655 |
| 7,117,553 | B2 * | 10/2006 | Fairchild | A47D 13/08 5/655 |
| 7,584,515 | B2 * | 9/2009 | Jones | A47G 9/02 2/69.5 |
| 7,874,032 | B2 * | 1/2011 | North | A47C 20/02 5/632 |
| 8,015,975 | B2 * | 9/2011 | Zohlmann, Jr. | A41D 15/04 128/848 |

(Continued)

*Primary Examiner* — Robert G Santos
(74) *Attorney, Agent, or Firm* — Hitchcock Evert LLP

(57) ABSTRACT

This invention relates to a repositioning device that is used for treating orthopedic conditions, diseases and injuries in infants, including plagiocephaly. The repositioning device comprises a wrap and a side support that, during use of the repositioning device, allows for the passive rotation of an infant's neck, gradual elongation of an infant's head and stretching of an infant's musculoskeletal system.

21 Claims, 7 Drawing Sheets

(56) References Cited

U.S. PATENT DOCUMENTS 8,272,385 B2 * 9/2012 Crocetti ..... A61F 5/56 128/848
8,356,602 B2 * 1/2013 Crocetti ..... A61F 5/56 128/848
8,429,775 B2 * 4/2013 North ..... A47C 20/02 5/633
8,584,680 B2 * 11/2013 Crocetti ..... A61F 5/56 128/848
8,720,447 B2 * 5/2014 North ..... A61F 5/56 128/845
9,585,499 B2 * 3/2017 North ..... A47G 9/10
10,004,628 B2 * 6/2018 DeSantis ..... A61F 5/3784
10,477,976 B2 * 11/2019 North ..... A61B 5/14542
2005/0278857 A1 * 12/2005 Fairchild ..... A47D 15/008 5/655
2007/0256695 A1 * 11/2007 Crocetti ..... A61F 5/56 128/848
2008/0023011 A1 * 1/2008 Zohlmann ..... A41D 10/00 128/848
2009/0056017 A1 * 3/2009 Jones ..... A47G 9/02 5/485
2009/0313761 A1 * 12/2009 North ..... A47C 20/02 5/632
2010/0319131 A1 * 12/2010 North ..... A47C 20/02 5/633
2011/0078859 A1 * 4/2011 North ..... G06Q 30/0241 5/632
2011/0174321 A1 * 7/2011 Crocetti ..... A61F 5/56 128/871
2011/0179573 A1 * 7/2011 North ..... A61F 5/56 5/632
2013/0014766 A1 * 1/2013 Crocetti ..... A61F 5/56 128/848
2014/0041123 A1 * 2/2014 North ..... A47G 9/10 5/632
2015/0265452 A1 * 9/2015 DeSantis ..... A61F 5/3784 128/871
2017/0172308 A1 * 6/2017 North ..... A61B 5/11
2018/0271693 A1 * 9/2018 DeSantis ..... A61F 5/37

* cited by examiner

INFANT REPOSITIONING DEVICE

FIELD OF DISCLOSURE

The invention relates generally to cranial repositioning and shaping devices for infants.

BACKGROUND

Plagiocephaly is a condition seen among newborns. Congenital plagiocephaly may be caused by restrictive intrauterine positioning, and positional plagiocephaly may be caused or by an infant's natural inclination to rotate his or her head to one side over another during sleep. Plagiocephaly may also be a symptom of congenital muscular torticollis or another orthopedic condition affecting the infant's musculoskeletal system.

Existing solutions for addressing cranial conditions, like plagiocephaly, include cranial helmets and repositioning pillows. However, cranial helmets and repositioning pillows still have many drawbacks. Cranial helmets must be worn nearly all day for several weeks and even months, depending on a variety of factors, such as the infant's age and severity of cranial condition. Cranial helmets are also heavy, very expensive, and not typically covered under insurance plans. Helmets can also cause skin irritation because infants must wear them virtually all day, every day for weeks. Repositioning pillows, on the other hand, do not encourage infants to stretch and elongate the muscles in their neck, and as such, are unlikely to treat additional orthopedic conditions commonly associated with positional and congenital plagiocephaly.

Accordingly, there is a need for a breathable, low cost, passive repositioning device for addressing and treating plagiocephaly and similar orthopedic conditions.

SUMMARY

The present disclosure teaches a repositioning device that allows for the passive repositioning of an infant's head, neck and spine. This device may comprise a wrap, sleeve and side support. In some embodiments, the repositioning device further comprises a placement marker for verifying proper placement of an infant on the wrap of the repositioning device. The wrap, sleeve and side support may each be adjustable in size and comprise a wide variety of materials depending on factors such as breathability and durability of the material, pliability and firmness of the side support, and so on. Once the wrap is folded around the infant and the side support engages the infant's spine and shoulder, the repositioning device prevents the infant from rolling onto his or her favored side, thereby stretching the infant's cervical muscles on his or her affected side and allowing any cranial condition on the infant's affected side to elongate. The repositioning device may be used for treating a wide variety of orthopedic conditions, diseases and injuries, such as positional plagiocephaly, congenital plagiocephaly, torticollis, brachycephaly, scoliosis, cerebral palsy and the like. The repositioning device may additionally be used for preventing these types of orthopedic conditions, diseases and injuries.

Additional aspects, advantages and features are included in the following examples. The examples and descriptions should be taken in conjunction with the accompanying figures, wherein numerals are used to describe the same feature throughout the embodiments and figures.

A BRIEF DESCRIPTION OF THE DRAWINGS

Embodiments will now be described, by way of example only, with references to the accompanying drawings in which.

DETAILED DESCRIPTION

While this invention may be embodied in many different forms, there will herein be described in detail preferred embodiments of the invention with the understanding that the present disclosure exemplifies the principles of the invention and is not intended to limit the broad aspects of the invention to the embodiments illustrated. It will be understood that the invention may be embodied in other specific forms without departing from the spirit or central characteristics thereof. Therefore, the present embodiments should be considered in all respects as illustrative and not restrictive, and the invention is not to be limited to the details given herein.

Figure 1:
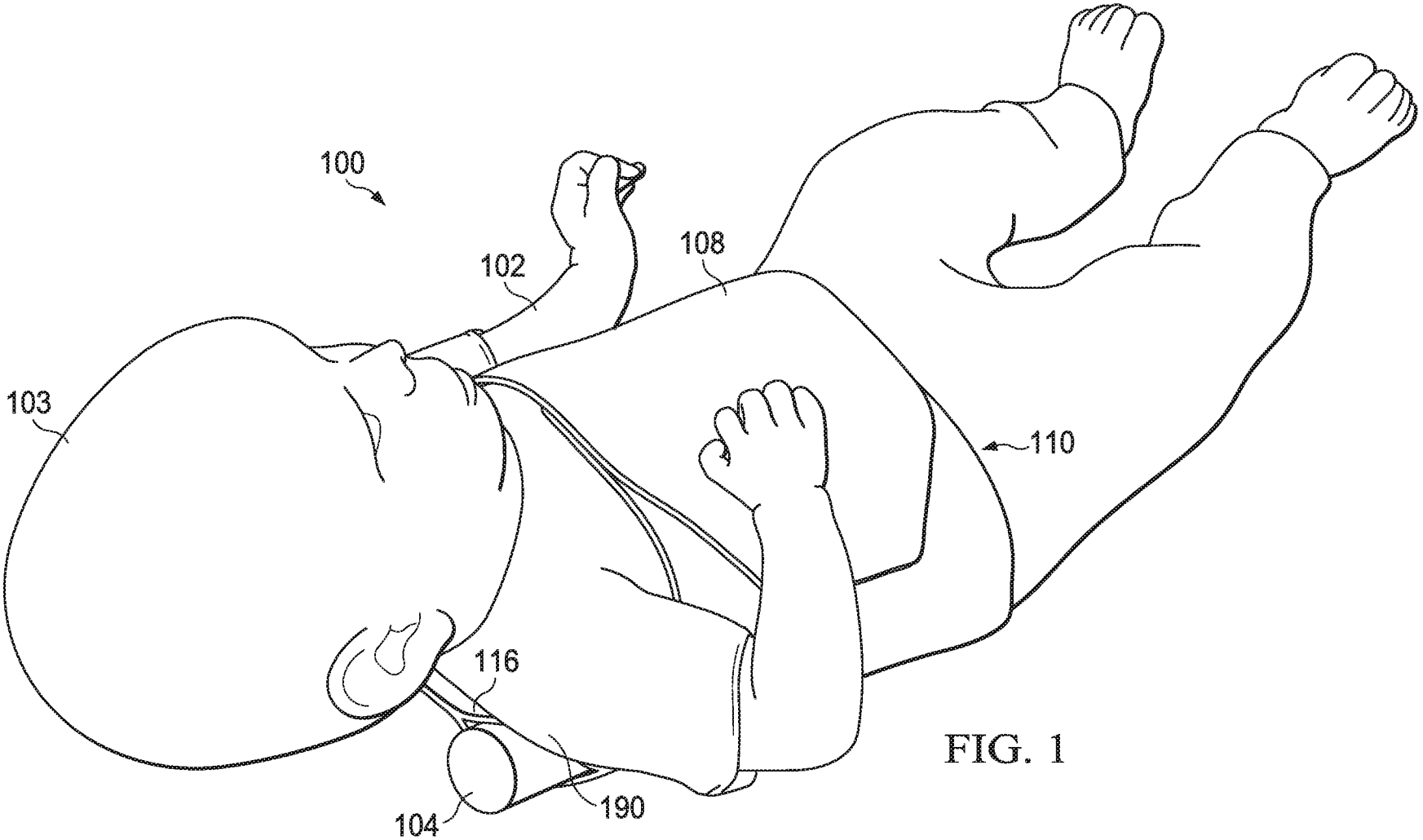
FIG. 1 is a perspective view of an embodiment of a repositioning device as used on an infant.
Figure 2:
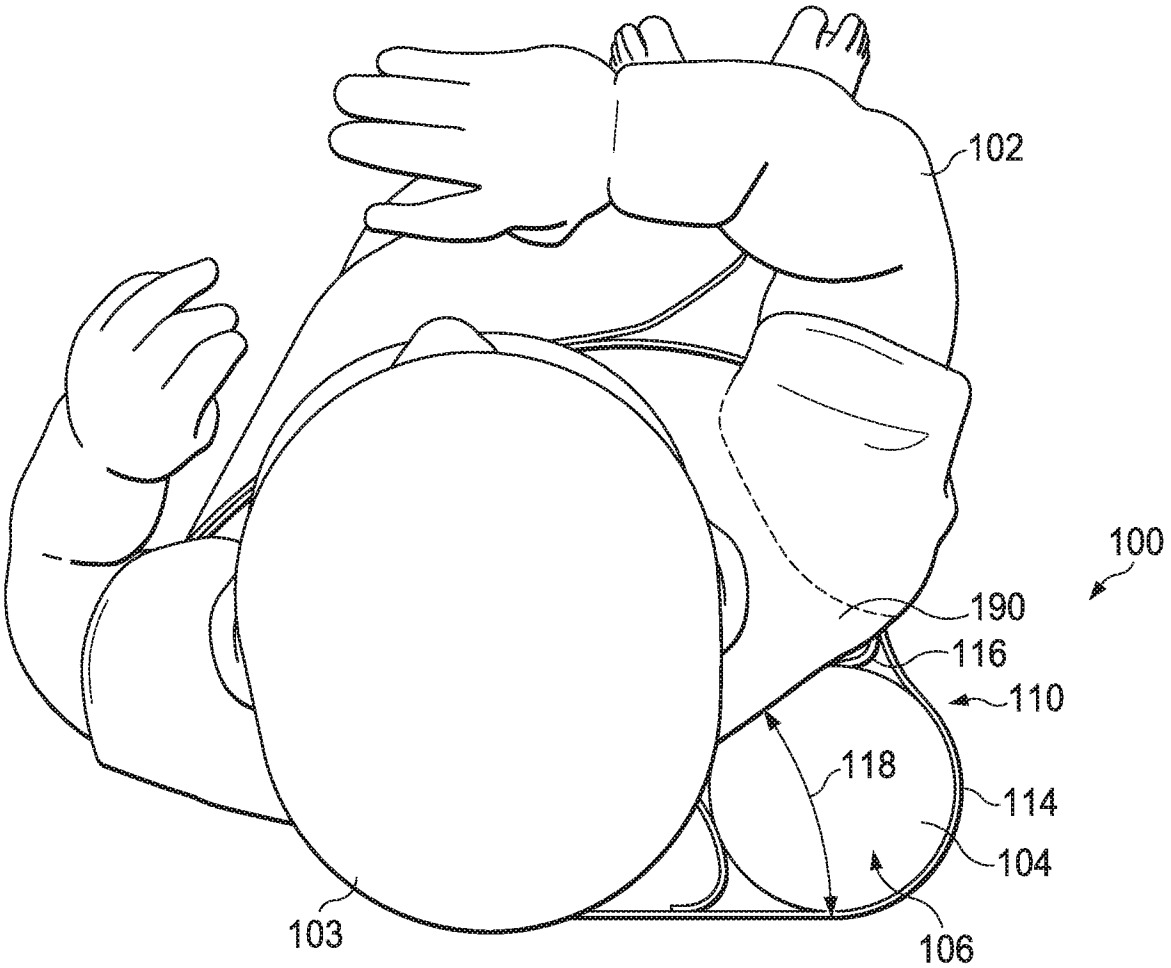
FIG. 2 is a top view of the embodiment of the repositioning device as used on an infant.

FIGS. 1 and 2 show how a repositioning device 100 may be placed around the torso of an infant 102. Although FIGS. 1 and 2 show infant's head 103 as being oval and symmetrical, it will be understood by one skilled in the art that FIGS. 1 and 2 are merely illustrations of how repositioning device 100 may be used. For example, the repositioning device 100 of FIGS. 1 and 2 may be used for treating flatness or another condition appearing on the right side of an infant's posterior occipital bone and/or parietal bone because the device 100 is positioned to the right of infant's spine.

As shown in FIG. 1, repositioning device 100 comprises a wrap 110 that is folded around infant 102. The ends of wrap 110 may be connected or attached near the front 108 of wrap 110 by a buckle, strap, zipper, adhesive, hook-and-loop fastener, button, snap closure, and/or by another type of connector that allows the ends to remain in place during use of repositioning device 100. The length and width of wrap 110 may vary depending on the age, weight and size of infant 102. In some embodiments, the width of wrap 110 is between seven and nine inches.

The wrap 110 further comprises a side support 104 inside a sleeve 116 that extends from one side of wrap 110 to the other side of wrap 110. During use of repositioning device 100, the side support 104 is placed inside sleeve 116, and the infant 102 is placed on top of an open wrap 110. In this embodiment, the side support 104 was placed to the right of the spine of infant 102, adjacent to the right shoulder 190 of infant 102, to prevent infant 102 from rolling onto his or her right side. Conversely, if infant 102 has flatness on the left side of infant's head 103, then repositioning device 100 would be positioned to the left of the spine of infant 102, adjacent to the left shoulder of infant 102, to prevent the infant 102 from rolling onto his or her left side.

Wrap 110 may comprise a wide variety of fabrics, textiles, and other materials, depending on certain desired characteristics of repositioning device 100, such as elasticity, breathability and durability. Additional factors include the ability of the material to resist stains, to wick moisture, and to stretch and retain shape after numerous uses and washes. Wrap 110 may comprise a breathable material, such as cotton or linen, and/or comprise a weave of materials, such as muslin. In other embodiments, wrap 110 may comprise a flame-resistant material, such as nylon. Wrap 110 may further comprise materials that are elastic, such as polyester, neoprene, Lycra® and spandex, to allow for repeated stretching of the material during use of repositioning device 100. Wrap 100 may comprise a stain-resistant or performance fabric to repel moisture and resist staining. Wrap 110 may additionally comprise other design elements, such as mesh designs, breathable weaves, layering designs and other blends and combinations of design features. One skilled in the art will recognize that wrap 110 may comprise additional natural or synthetic materials and/or a combination of these materials to achieve a variety of desired characteristics.

Wrap 110 may comprise a single sheet of material or a plurality of sheets of one or more materials. In some embodiments, a single sheet of cotton may be desired to improve breathability and decrease the overall weight of wrap 110. In other embodiments, wrap 110 may comprise a plurality of sheets, such as two or more layers of cotton or some combination of cotton and fleece, for added warmth. In this embodiment, the front 108 of wrap 110 has a tapered end to allow for a firm connection to the other end of wrap 110 and for providing an aesthetically pleasing design. However, in other embodiments, both ends of wrap 110 may have a tapered shape. Alternatively, neither end may be tapered.

Side support 104 may likewise comprise a variety of materials depending on certain desired characteristics of repositioning device 100, such as durability, pliability and firmness. Additional factors include the ability of the material to resist stains, to wick moisture, to retain shape after numerous uses and washes, and to remain in place during use of repositioning device 100. In this embodiment, side support 104 comprises a polyurethane foam, which may reduce or eliminate any unintended movement of side support 104 inside sleeve 116 during use of the repositioning device 100.

In other embodiments, side support 104 may comprise a firm material, such as latex, cotton, linen, rubber, silicone or some combination of materials. One skilled in the art will recognize that side support 104 may comprise additional natural or synthetic materials and/or a combination of these materials to achieve a side support 104 that is sufficient to support the weight of and rotate an infant during use of repositioning device 100.

In some instances, it may be desirable for side support 104 to further comprise a removable cover. In such an embodiment, the interior section of side support 104 may comprise a firm material, such as foam, latex, rubber or silicone, and the removable cover may comprise a breathable and stain-resistant material, such as cotton. Removable cover may comprise the same material or a different material than wrap 110. The removable cover may be removed from the interior section of side support 104 for washing. In doing so, the integrity of the interior section of side support 104 may be preserved for numerous, additional uses of repositioning device 100.

FIG. 2 illustrates how repositioning device 100 may be configured to passively reposition the neck, spine and head 103 of an infant 102 who has symptoms of plagiocephaly, brachycephaly, torticollis or another orthopedic condition. In this embodiment, repositioning device 100 comprises a wrap 110, sleeve 116, outer sleeve layer 114 and side support 104. While sleeve 116 is shown as being a separate material that is sewn, adhered or otherwise attached to a central area of wrap 110, sleeve 116 and wrap 110 may be a contiguous sheet of a single material or combination of materials.

Once side support 104 is placed inside an opening 106 of sleeve 116, infant 102 may be placed on top of an open wrap 110 so that side support 104 and sleeve 116 are substantially parallel to the spine of infant 102. The ends of wrap 110 may be pulled together and connected around infant 102, whereby the right shoulder 190 of infant 102 is engaged with side support 104 and sleeve 116 of repositioning device 100 at an acute angle 118 relative to a surface, such as a table, bed or the ground.

As discussed previously, the embodiment shown in FIG. 2 would address plagiocephaly or another cranial abnormality observed on the right, posterior side of infant's head 103, indicating that infant 102 may prefer to roll onto his right side. By shifting the weight and position of the infant and preventing infant 102 from rolling onto his favored right side, repositioning device 100 allows the right, posterior side of infant's head 103 to elongate so that it appears symmetrical to the left, posterior side of infant's head 103.

In addition, repositioning device 100 may also be used for stretching the cervical muscles of infant 102. For example, infants 102 with plagiocephaly or torticollis may have a shortened or tightened sternocleidomastoid or trapezius muscle on their affected side. By placing repositioning device 100 on the affected side of infant 102, the cervical muscles of infant 102 are stretched and elongated in the direction of limitation. In the embodiment shown in FIG. 2, infant's right sternocleidomastoid and/or trapezius muscles would be stretched and elongated toward the infant's left side.

Side support 104 may vary in size based on an infant's severity of orthopedic condition or based on an infant's size, age or weight. For example, if the infant 102 has a limited range of motion, a user may wish to treat infant 102 with a smaller support 104 that would result in a smaller acute angle 118 of infant 102. Conversely, if the infant 102 has a greater range of motion, a user may wish to treat infant 102 with a larger support 104 that would result in a larger acute angle 118 of infant 102. It will be understood by one skilled in the art that the size of side support 104 may vary based on other factors needed for treating an orthopedic condition of infant 102.

Figure 3:
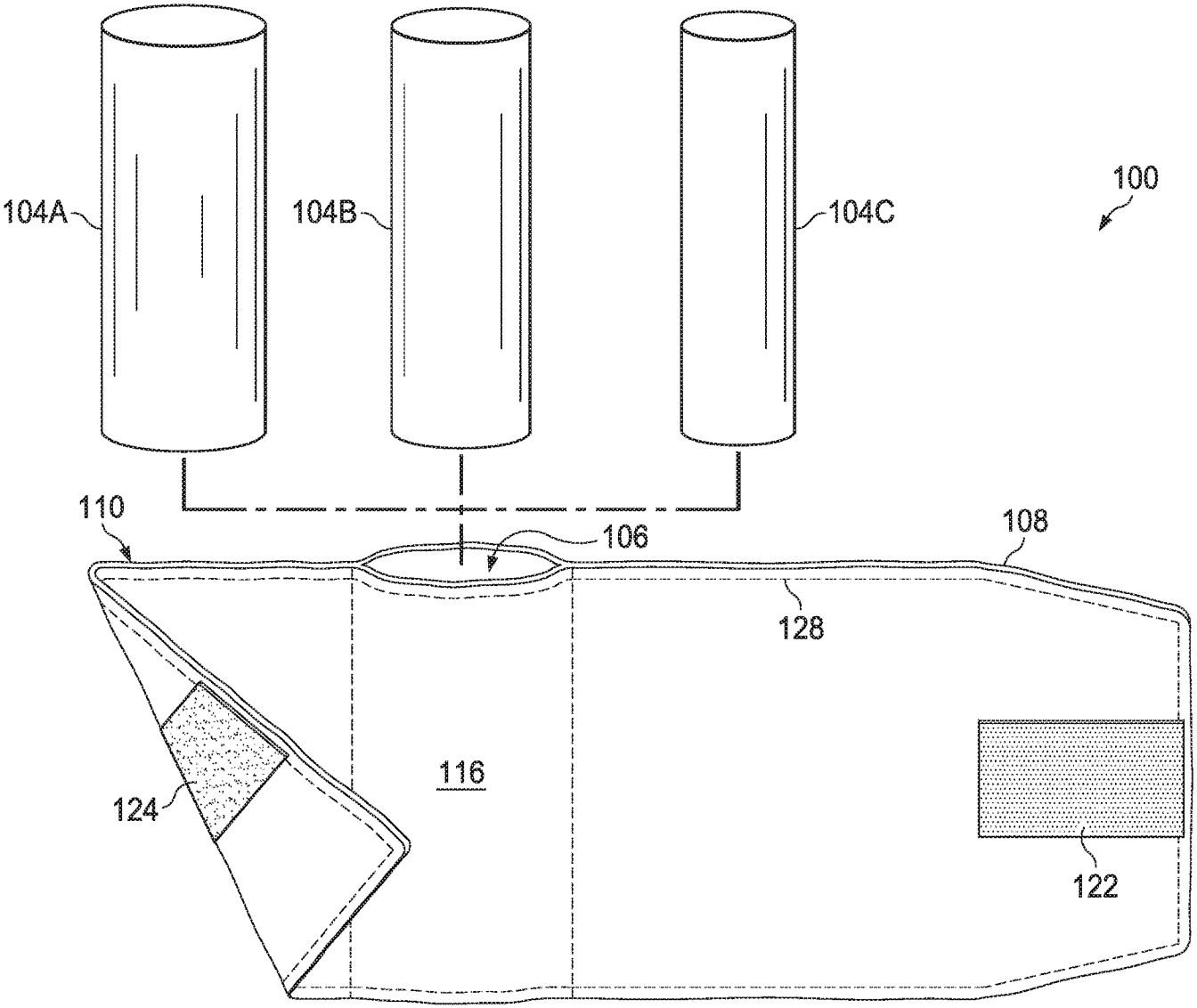
FIG. 3 is an exploded view of the embodiment of the repositioning device.

FIG. 3 is an exploded view of repositioning device 100. In this embodiment, the wrap 110 of repositioning device 100 is in an open state. Wrap 110 has a connector 122 on one end that connects to a corresponding connector 124 on the other end. For example, connector 122 may be on an inner layer near the front 108 of wrap 110, and the corresponding connector 124 may be on an outer layer at the other end of wrap 110, allowing repositioning device 100 to be folded around the infant and connected together during use. In this embodiment, connectors 122 and 124 are hook-and-loop fasteners, but it will be understood by one having skill in the art that any other type of connector configured for attaching the ends of wrap 110 together may be used, such as a buckle, strap, adhesive, button, zipper, snap closure and/or another type of connector that allows the ends to remain in place. The length and width of connectors 122 and 124, such as hook-and-loop fasteners, may also vary based on the infant's size, age or weight. In this embodiment, connectors 122 and 124 are sufficiently wide to allow for a firm connection around infants of varying sizes and weights.

In this embodiment, wrap 110 additionally comprises two layers of material or a plurality of materials. An outer wrap layer is sewn to an inner layer of wrap 110 along a seam 128. Sleeve 116 is also shown as sewn to wrap 110 along seams 128. It will be understood that the plurality of layers may alternatively be adhered or otherwise attached to one another. In some embodiments, wrap 110 comprises a single layer of material, such as single-ply cotton, for improved breathability. In other embodiments, wrap 110 may comprise a plurality of materials across sections of wrap 110. For example, the front 108 of wrap 110 may comprise a material, and the back of wrap 110 may comprise an alternative material. In some embodiments, sleeve 116 may comprise a contrasting color, pattern or material relative to the front 108 and/or back of wrap 110. Similarly, one or more seams 128 may comprise a color that contrasts to wrap 110.

Sleeve 116 may be configured to accommodate a variety of sizes of side support 104, such as a small, side support 104C, a medium, side support 104B, and a large, side support 104A. In other embodiments, sleeve 116 may be configured for a particular size of side support 104. For example, the width of sleeve 116 may be substantially the same as the diameter of the particular side support 104 that is placed inside sleeve 116, thereby reducing or eliminating movement of side support 104 inside sleeve 116.

In some embodiments, sleeve 116 may comprise a plurality of pockets inside sleeve 116. For example, sleeve 116 may comprise a large, internal pocket for a large, side support 104A and a small, internal pocket for a small, side support 104C. It will be understood that the number of internal pockets inside sleeve 116 may vary. In other embodiments, wrap 110 may comprise a plurality of sleeves 116. For example, wrap 110 may comprise two sleeves 116 that are positioned side by side or spaced apart from one another on wrap 110, such that one sleeve 116 can accommodate a side support 104 and another sleeve 116 can accommodate the same size of side support 104 or a smaller or larger side support 104.

As discussed previously, the size of side support 104 may vary based on the type or severity of an infant's orthopedic condition or based on the infant's size, age or weight. For example, a large, side support 104A may be used for treating a larger or older infant and a small, side support 104C may be used for treating a smaller or younger infant.

In addition, a large, side support 104A may be used for treating an infant who has severe symptoms; a medium, side support 1046 may be used for treating moderate symptoms; and a small, side support 104C may be used for treating minor symptoms. In some instances, a user may wish to begin treatment with a large, side support 104A and, as the infant's affected side improves, the user may wish to gradually begin using a medium, side support 104B and/or a small, side support 104C until the infant's orthopedic condition has been treated and use of repositioning device 100 is no longer needed. For example, a physical therapist may select the large, side support 104A for treating an infant with severe plagiocephaly. After several weeks of therapeutic sessions, the infant's symptoms may improve. The physical therapist may then select the medium, side support 1046 for treating the infant's improved, moderate symptoms of plagiocephaly. The physical therapist may continue this pattern until the infant's head appears symmetrical or the orthopedic condition is otherwise treated.

In other instances, a user may wish to begin treatment with a small, side support 104C and, as the infant's affected side improves, the user may wish to gradually begin using a medium, side support 104B and/or a large, side support 104A until the infant's orthopedic condition has been treated and use of repositioning device 100 is no longer needed. For example, a user may select the small, side support 104C for treating an infant with severe torticollis. After several therapeutic sessions, the infant may have a greater range of motion. The user may then select the medium, side support 1046 and/or the large, side support 104A for treating the infant's now moderate symptoms of torticollis.

One skilled in the art will also understand that it may be desirable to use repositioning device 100 while an infant's cranium is still malleable. For example, a user may begin use of repositioning device 100 when an infant is between two and six months old. The length of treatment and frequency of individual treatment sessions may additionally vary based on the infant's size, age or weight or based on the type or severity of an infant's orthopedic condition.

It will further be understood that repositioning device 100 may prevent orthopedic conditions, such as positional plagiocephaly, from occurring in newborns. For example, repositioning device 100 may be used in hospitals, such as in a neonatal intensive care unit, and other healthcare facilities. A healthcare professional may use repositioning device 100 to maintain a newborn's position and/or use repositioning device 100 to shift a newborn's weight and position, thereby allowing both posterior sides of a newborn's head to elongate naturally. In some embodiments of repositioning device 100, the size and diameter of side support 104 may be adjustable. For example, side support 104 may be hollow and able to be inflated with air or another gas, such as helium or nitrogen. In such an embodiment, side support 104 may comprise a plastic, vinyl, poly-vinyl chloride resin or any other material that is capable of being filled with a gas. An inflatable, side support 104 may further comprise varying degrees of air or gas, depending on the desired size of side support 104. It will be understood that an adjustable side support 104 may be used for treating a wide variety of orthopedic conditions.

In other embodiments, side support 104 may comprise a plurality of concentric side supports 104 for ease of use, manufacturing and packaging. For example, a medium, side support 1046 and/or a large, side support 104A may be hollow and configured to attach to a small, side support 104C. The plurality of concentric side supports 104 may be attached by a snap-fit connection or any other connection that would allow the concentric side supports 104 to be attached and detached during use of repositioning device 100. In addition, each concentric side support 104 may comprise varying colors or additional markings to denote the size or another characteristic of the side support 104.

Side support 104 may additionally vary in shape based on an infant's severity of orthopedic condition or based on an infant's size, age or weight. For example, side supports 104 are shown as having a cylindrical shape, but side support 104 may have a smaller or larger diameter on one end, giving size support 104 an angled or tapered shape. Side support 104 may have a wedge shape and/or any another shape that would prevent infant 102 from rolling onto his or her favored side during use of repositioning device 100.

Figure 4:
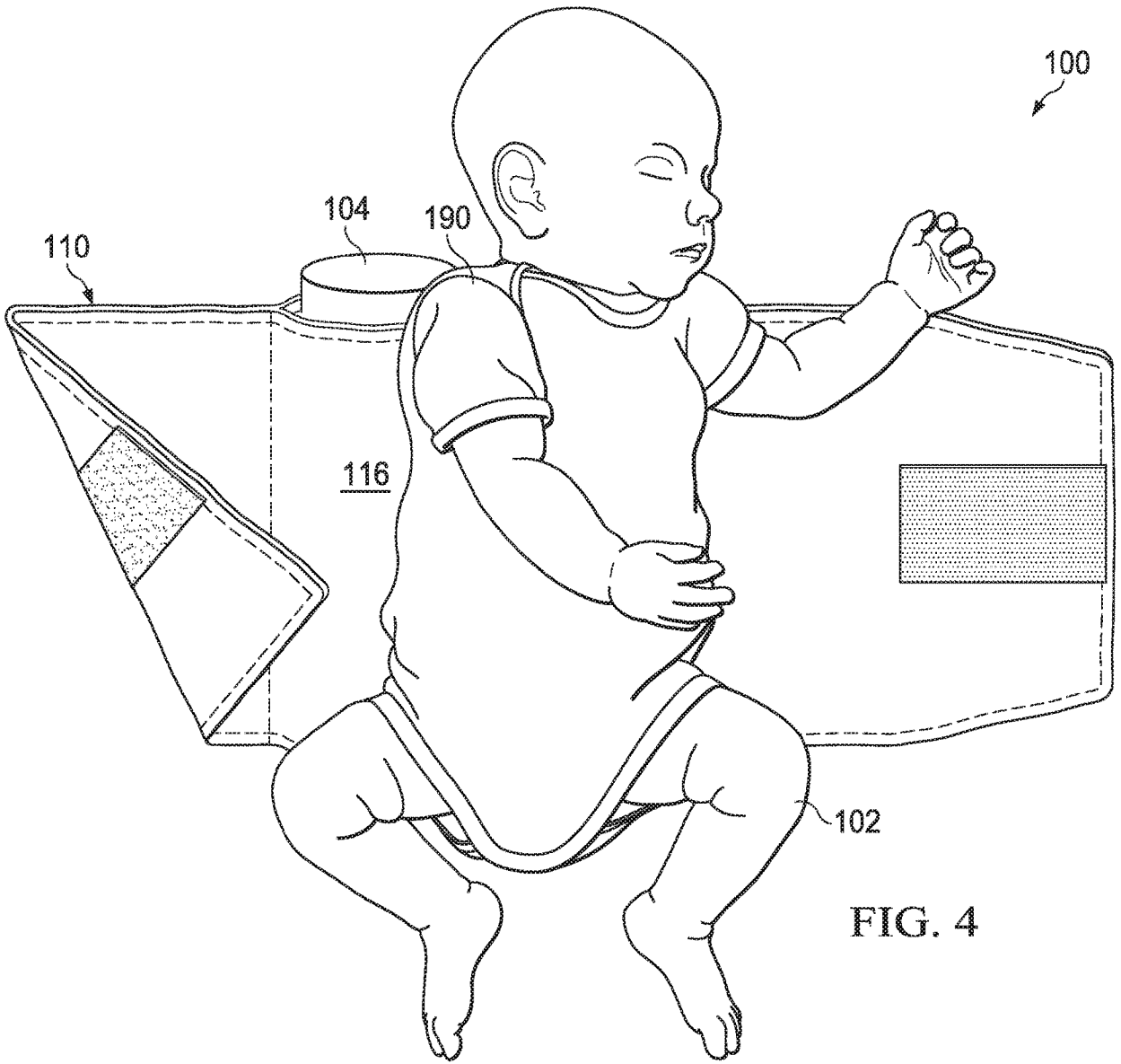
FIG. 4 is a front view of the embodiment of the repositioning device, demonstrating a placement of an infant on the repositioning device.

FIG. 4 demonstrates a proper placement of infant 102 on repositioning device 100. During use of repositioning device 100, a user, such as a parent, caretaker, physical therapist, or another healthcare professional, may place side support 104 inside the opening of sleeve 116. Once assembled, infant 102 would be placed on an open wrap 110 so that side support 104 and sleeve 116 are substantially parallel to the spine of infant 102. Side support 104 may extend along the infant's spine to the infant's mid-thoracic region. The ends of wrap 110 would then be pulled together and wrapped around infant 102 and connected together at the front of the infant 102, thereby allowing side support 104 and sleeve 116 to engage the spine and shoulder 190 of infant 102 and passively reposition infant 102 at an acute angle relative to a surface, such as a table, bed or the ground (see acute angle 118 in FIG. 2). A user may additionally rotate infant 102 to achieve a greater extension and stretching of infant's affected side and cervical muscles.

The length of side support 104 may additionally vary. In this embodiment, an end of side support 104 is protruding from sleeve 116. An elongated side support 104 may provide additional support for the infant 102 and/or may allow a user to remove side support 104 from sleeve 116 more easily. In other embodiments, side support 104 may be substantially the same length as or shorter in length than sleeve 116 such that, when side support 104 is placed inside sleeve 116, side support 104 is not visible during use of repositioning device 100.

It will be understood by one skilled in the art that the placement of repositioning device 100 adjacent to the right side of infant 102 would address plagiocephaly or another cranial condition observed on the right, posterior side of infant's head, indicating that infant 102 may prefer to roll onto his right side. By shifting the weight and position of the infant and preventing infant 102 from rolling onto his favored right side, repositioning device 100 allows the right, posterior side of the head of infant 102 to elongate so that it appears symmetrical to the left, posterior side of the head of infant 102.

Figure 5:
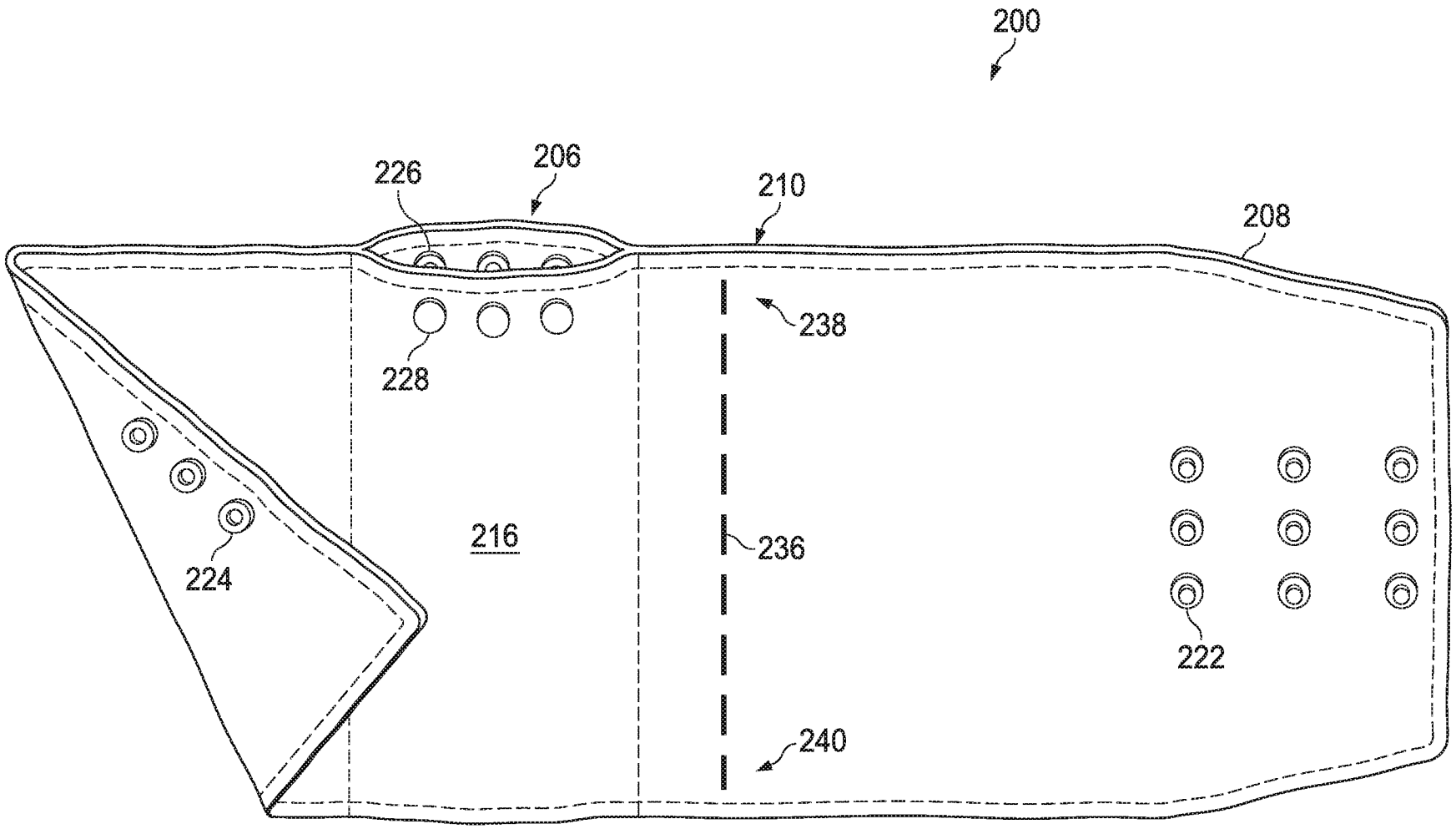
FIG. 5 is a front view of another embodiment of a repositioning device.

FIG. 5 shows another embodiment of a repositioning device comprising connectors that are configured to accommodate a variety of sizes, ages and weights of infants. For example, wrap 210 may have a single row of connectors 224 on one end and a series of corresponding connectors 222 on the other end, near the front 208 of wrap 210. In some instances, the single row of connectors 224 may be attached to the outer row of corresponding connectors 222 if the infant is generally larger in size. In other instances, the single row of connectors 224 on one end of wrap 210 may be attached to the inner row of corresponding connectors 222 if the infant is generally smaller in size. Connectors 222 and 224 on the ends of wrap 210 may be attached in a variety of manners to allow for a firm connection around the infant.

The number of individual connectors 222 and 224 may vary, as well as the number of rows of connectors 222 and 224, allowing for a wide variety of adjustments to the size of wrap 210. For example, wrap 210 may comprise one or more individual connectors in each row of corresponding connectors 222 and connectors 224. Moreover, wrap 210 may comprise one or more rows of connectors 224 and one or more rows of corresponding connectors 222. In this embodiment, connectors 224 and 222 are snap closures, but it will be understood by one having skill in the art that any other type of connector configured for attaching and pulling the ends of wrap 210 together may be used, such as a buckle, strap, hook-and-loop fastener, button, zipper and/or adhesive.

Repositioning device 200 further comprises sleeve connectors 226 on an outer layer of sleeve 216 that attach to sleeve connectors 228 on an inner layer of sleeve 216. In this embodiment, a side support may be placed inside an opening 206 of sleeve 216, after which sleeve 216 may be closed by attaching sleeve connectors 226 and 228. Closing sleeve 216 may reduce or eliminate any unintended movement of the side support inside sleeve 216 during use of repositioning device 200. For example, it may be desirable to close sleeve 216 to prevent an infant from inadvertently pushing a side support out of sleeve 216 and/or to prevent a side support from falling out of sleeve 216 during rotation and/or movement of wrap 210. The number and placement of sleeve connectors 226 and 228 on sleeve 216 may additionally vary. For example, sleeve 216 may comprise one or more individual sleeve connectors 226 and 228.

Moreover, the size of sleeve 216 may be adjustable. For example, sleeve 216 may comprise a plurality of sleeve connectors 226 and 228 along a vertical plane of sleeve 216, allowing a user to tighten or narrow sleeve 116 around a side support. In this embodiment, sleeve connectors 226 and 228 are shown as snap closures, but it will be understood by one having skill in the art that any other type of connector configured for adjusting the size of sleeve 216 and/or attaching the ends of wrap 210 may be used, such as a buckle, strap, hook-and-loop fastener, button, zipper and/or adhesive.

The wrap 210 of repositioning device 200 further comprises a placement marker 236 adjacent to sleeve 216 that allows a user to verify that the infant has been properly placed on the wrap 210 of repositioning device 200. In this orientation of repositioning device 200, a user may align the infant's spine along placement marker 236, such that the infant's right shoulder is adjacent to one end 238 of placement marker 236 and the infant's right side of his or her pelvis is adjacent to another end 240 of placement marker 236. Once aligned, the user would fold the first end of wrap 210 around the infant, fold the second end of wrap 210 across the first end and attach the ends together by connectors 222 and 224. Once the repositioning device 200 is wrapped around the infant, one end of side support may be positioned directly under the blade of infant's right shoulder.

In this embodiment, the placement marker 236 is positioned on an inside of wrap 210, but in other embodiments, the placement marker 236 may be positioned on an outside of wrap 210, allowing a user to verify proper placement of the infant during use of repositioning device 200.

Repositioning device 200 is also configured to be rotatable. By rotating the repositioning device 200 by 180 degrees, a user may apply similar techniques to address a cranial condition on an infant's left side. In that instance, a user may align the infant's spine along placement marker 236, such that the infant's left shoulder is adjacent to end 240 of placement marker 236 and the infant's left side of his or her pelvis is adjacent to end 238 of placement marker 236. The user may further verify that the infant's left shoulder is engaged with the side support and sleeve 216 before folding and connecting the ends of wrap 210 together around the infant's mid-thoracic region.

Some embodiments of wrap 210 may comprise a plurality of sleeves 216. For example, wrap 210 may comprise two or more sleeves 216 that are positioned side by side or spaced apart from one another, such that one sleeve 216 can accommodate a side support and another sleeve 216 can accommodate another side support. In such an embodiment, a placement marker 236 may divide the sleeves 216 or be positioned on top of one sleeve 216. Wrap 210 may further comprise a plurality of placement markers 236 corresponding to the plurality of sleeves 216. For example, wrap 210 may comprise a sleeve 216 and a placement marker 236 for an infant's left side and another sleeve 216 and another placement marker 236 for an infant's right side, such that repositioning device 200 may be used for treating an orthopedic condition on either side of an infant and/or for preventing an orthopedic condition from occurring in a newborn. The plurality of sleeves 216 and/or placement markers 236 may additionally comprise contrasting colors, patterns or materials relative to one another and/or wrap 210 to further signal where a user should place the infant, which sleeve 216 and marker 236 treats the infant's right side and which sleeve 216 and marker 236 treats the infant's left side.

Figure 6:
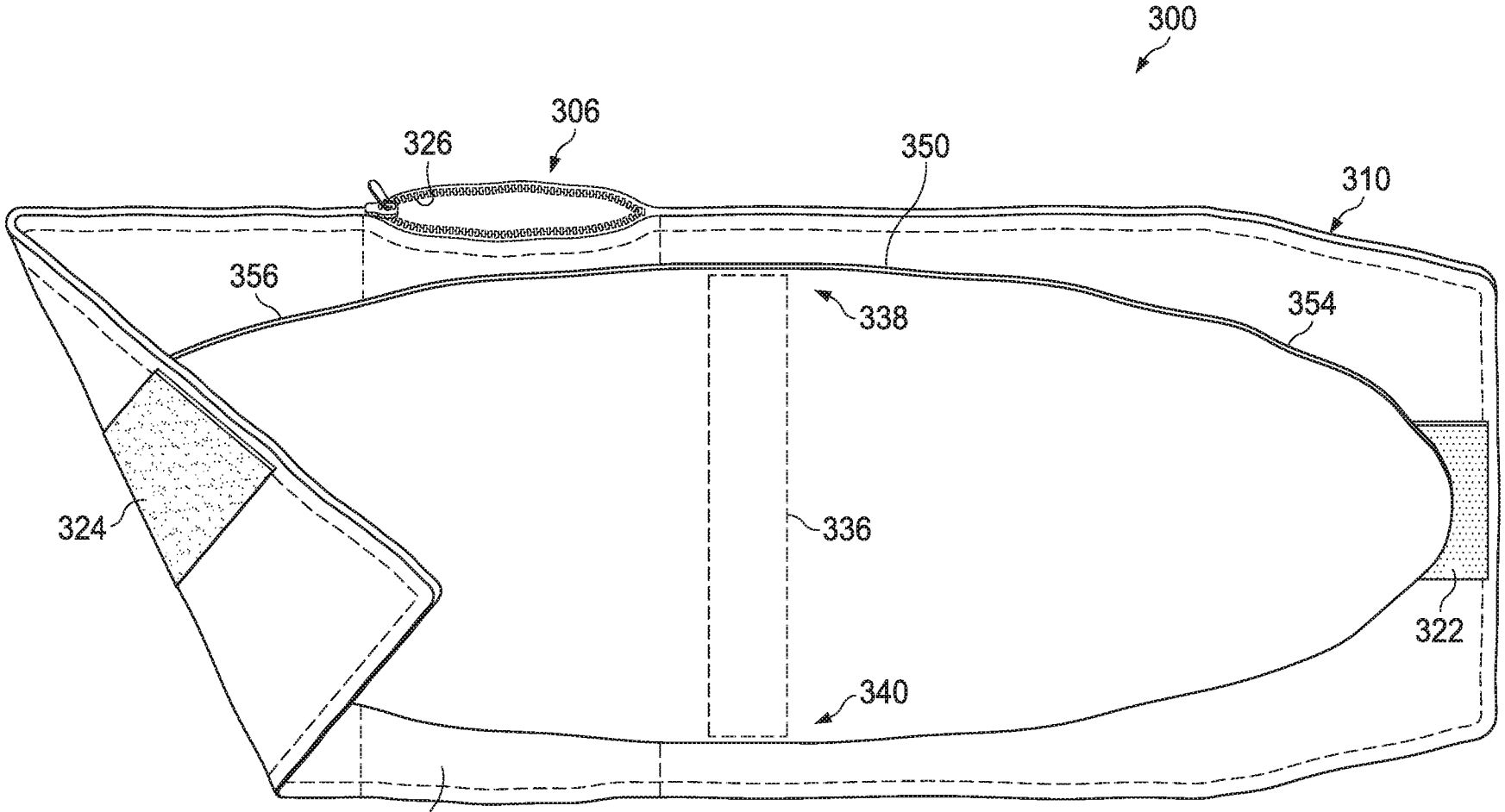
FIG. 6 is a front view of another embodiment of a repositioning device.

FIG. 6 illustrates another embodiment of a repositioning device. In this embodiment, repositioning device 300 comprises an interior panel 350 that is sewn or otherwise attached to wrap 310. Interior panel 350 may provide an additional layer of warmth and/or provide more comfort and support to the infant during use of repositioning device 310. Interior panel 350 comprises winged sections 354 and 356, which extend toward the ends of wrap 310.

Interior panel 350 may comprise a wide variety of fabrics, textiles, and other materials, depending on certain desired characteristics of repositioning device 300, such as elasticity, breathability and durability. Additional factors include the ability of the material to resist stains, to wick moisture, and to stretch and retain shape after numerous uses and washes. Interior panel 350 may comprise the same material or a different material or combination of materials than wrap 310.

In this embodiment, interior panel 350 is smaller in both length and width than wrap 310, but it will be understood that the length and/or width of interior panel 350 may vary based on the infant's size, age and weight. For example, a narrower interior panel 350 may allow for more breathability while also providing additional support for the infant. The ends of winged sections 354 and 356 also have a tapered shape, which may allow a user to easily pull the ends and wrap them around the infant's mid-thoracic region. However, in other embodiments, the ends of winged sections 354 and 356 may not be tapered.

Interior panel 350 further comprises a placement marker 336 that is adjacent to sleeve 316 and sewn or otherwise attached to the interior panel 350. Placement marker 336 may additionally comprise a contrasting color, pattern or material relative to the interior panel 350 and/or wrap 310 to further signal where a user should place the infant.

During use of repositioning device 300, a side support is placed inside an opening 306 of sleeve 316, which extends from one side of wrap 310 to another side of wrap 310 and is sewn or otherwise attached to a central area of wrap 310. Opening 306 may be closed by sleeve connector 326, which is shown in FIG. 6 as a zipper. A user may then place an infant on an open wrap 310 and interior panel 350 such that sleeve 316 and placement marker 336 are substantially parallel to the spine of the infant. In this orientation of repositioning device 300, a user would align infant's spine along placement marker 336, such that the infant's right shoulder is adjacent to one end 338 of placement marker 336 and the infant's right side of his or her pelvis is adjacent to another end 340 of placement marker 336. Once aligned, the ends of winged sections 354 and 356 would be pulled together and wrapped around the infant, after which the ends of wrap 310 would be pulled together and wrapped and attached together at the front of wrap 310 by connectors 322 and 324, allowing for passive repositioning of the infant. In this embodiment, sleeve connector 326 is a zipper, but it will be understood by one having skill in the art that any other type of connector configured for attaching the ends of wrap 310 together may be used, such as a buckle, strap, hook-and-loop fastener, adhesive, button and/or snap closure.

Repositioning device 300 is also configured to be rotatable. By rotating the repositioning device 300 by 180 degrees, a user may apply similar techniques to address a cranial condition on the infant's left side. In that instance, a user may align the infant's spine along placement marker 336, such that the infant's left shoulder is adjacent to end 340 of placement marker 336 and the infant's left side of his or her pelvis is adjacent to end 338 of placement marker 336.

Figure 7:
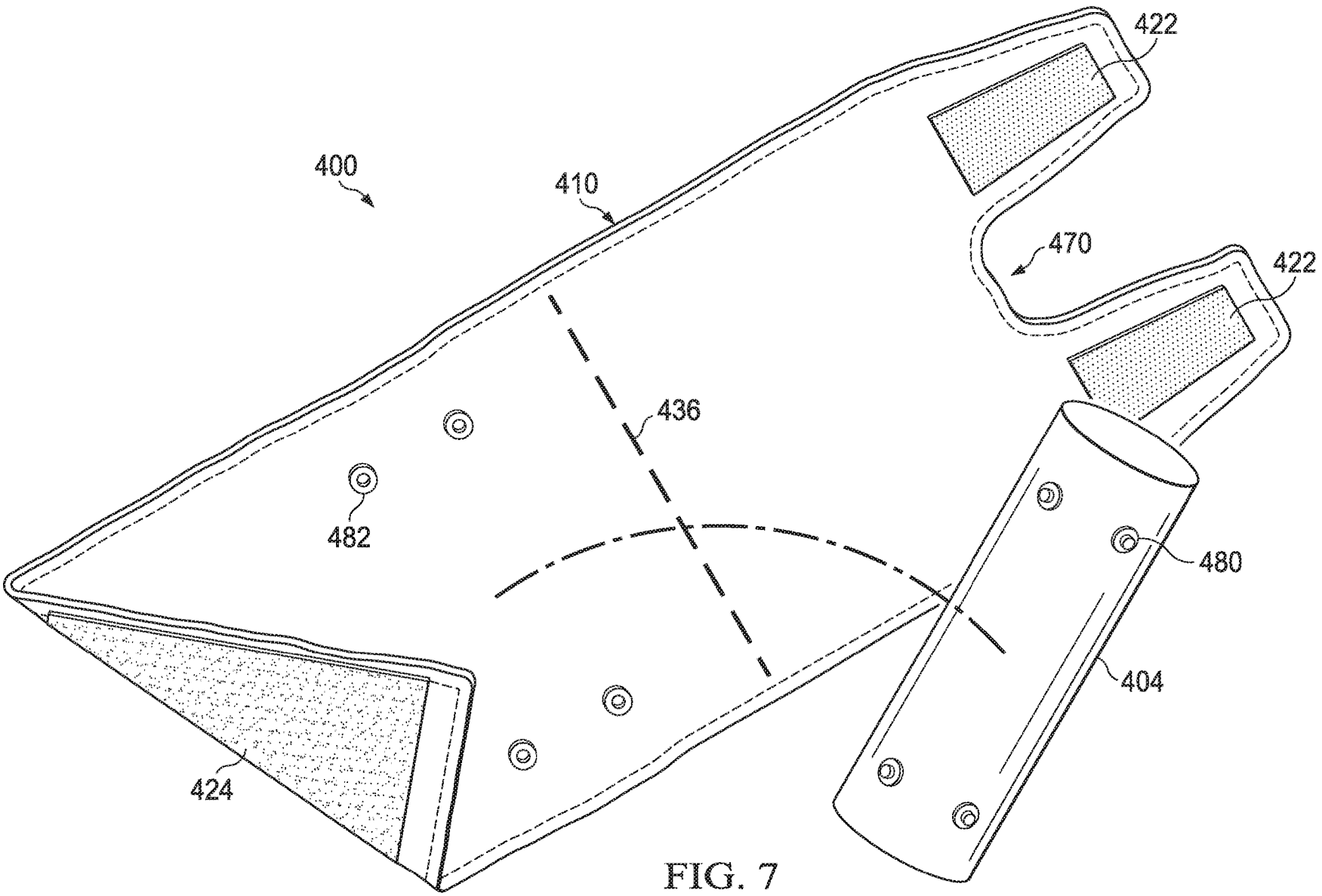
FIG. 7 is a front view of another embodiment of a repositioning device.

FIG. 7 shows yet another embodiment of a repositioning device. In this embodiment, repositioning device 400 comprises a wrap 410, connectors 422 and 424 at opposite ends of wrap 410, a placement marker 436 and a side support 404 that connects directly to wrap 410 by a series of connectors 480 on side support 404 and corresponding connectors 482 on wrap 410. Connectors 422 and 424 are shown as hook-and-loop fasteners and connectors 480 and 482 are shown as snap closures, but it will be understood that connectors 422, 424, 480 and 482 may further comprise adhesives, buttons, buckles, straps, zippers and/or another type of connector that would allow the ends of wrap 410 and the side support 404 to remain in place during use of repositioning device 100.

Wrap 410 further comprises a U-shaped end 470 that is configured to provide a firmer connection of wrap 410. For example, a user may fold the end of wrap 410 that comprises connector 424 over the top of an infant, connect a first connector 422 to connector 424 at a downward angle and connect a second connector 422 to connector 424 at an upward angle such that first and second connectors 422 cross each other along a central area of the U-shaped end 470. Alternatively, a user may connect first and second connectors 422 to connector 424 in any other manner that provides a firm connection between the ends of wrap 410. The U-shaped end 470 of wrap 410 may also provide a more flexible connection and allow a user to apply pressure at different points across the infant.

It will further be understood that the embodiment shown in FIG. 7 may also be rotated by 180 degrees to allow a user to treat an infant having a cranial condition on either side of his or her head, as described with respect to FIGS. 5 and 6. The orientation of the repositioning device 400 may treat a cranial condition on an infant's right side whereas the inverse orientation may treat a cranial condition on an infant's left side. In other embodiments, wrap 410 may comprise corresponding connectors 482 on both sides of placement marker 436.

The invention being therefore described and further described in the claims, it will be obvious that the same may be varied in many ways. Such variations are not to be regarded as a departure from the spirit and scope of the invention, and all such modifications as would be obvious to one skilled in the art are intended to be included within the scope of the devices and methods described herein.

The invention claimed is:

1. An infant repositioning device for treating an orthopedic condition, comprising:

a wrap comprising:

a body having a first end and a second end, wherein the first end and the second end are attached by a connector, wherein the connector allows a wrap adjustment to fit a torso circumference of an infant, and a sleeve in a central area of the wrap that extends substantially from a first side to a second side of the wrap, wherein the sleeve is defined by opposed layers of material forming the body;

a side support that is removable from the sleeve;

wherein, during use of the infant repositioning device, the side support engages a shoulder of the infant, thereby rotating the infant at an acute angle relative to a surface.

2. The infant repositioning device of claim 1, wherein the wrap further comprises a material that is one of a cotton, linen, nylon, polyester, neoprene, fleece and spandex.

3. The infant repositioning device of claim 1, wherein the wrap is one of elastic, flame resistant, breathable, moisture wicking, and washable.

4. The infant repositioning device of claim 1, wherein the side support further comprises a material that is one of a polyurethane, foam, latex, rubber and silicone.

5. The infant repositioning device of claim 1, wherein the wrap further comprises a placement marker that is positioned to align the infant on the wrap.

6. The infant repositioning device of claim 1, wherein the sleeve is adjustable.

7. The infant repositioning device of claim 1, wherein the side support is adjustable.

8. The infant repositioning device of claim 1, wherein the sleeve further comprises a sleeve connector configured for closing an opening of the sleeve.

9. The infant repositioning device of claim 8, wherein the sleeve connector is one of a buckle, strap, snap closure, zipper, adhesive, hook-and-loop fastener and button.

10. The infant repositioning device of claim 1, further comprising an interior panel attached to the wrap.

11. A repositioning device for treating orthopedic conditions, comprising:

a wrap comprising a first connector on a first end of the wrap and a second connector on a second end of the wrap;

a sleeve in a central area of the wrap, wherein the sleeve is defined by opposed layers of material forming the wrap;

a side support that is removable from the sleeve;

wherein the first connector and the second connector attach the first end and the second end of the wrap, wherein, during use of the repositioning device, the side support and the sleeve are parallel to a spine of an infant and the side support is held in a fixed position by the sleeve relative to the spine and supporting a shoulder of the infant; and wherein the repositioning device is rotatable between a first orientation and a second orientation, wherein the sleeve is positioned to a left of the spine in the first orientation and the sleeve is positioned to a right of the spine in the second orientation.

12. The repositioning device of claim 11, wherein the wrap is one of elastic, flame resistant, breathable, moisture wicking, and washable.

13. The repositioning device of claim 11, wherein the side support further comprises a material that is one of a polyurethane, foam, latex, rubber and silicone.

14. The repositioning device of claim 11, wherein the sleeve is adjustable.

15. The repositioning device of claim 11, wherein the side support is adjustable.

16. The repositioning device of claim 11, wherein the wrap further comprises a placement marker adjacent to the sleeve.

17. The repositioning device of claim 11, further comprising an interior panel attached to the wrap.

18. The repositioning device of claim 11, wherein the sleeve extends substantially from a first side of the wrap to a second side of the wrap, and during use, the side support extends from a pelvis to a shoulder of the infant along a single side of the infant.

19. A method for treating an orthopedic condition, comprising:

placing an infant on a wrap that comprises a sleeve defined by opposed layers of material forming the wrap and a side support that is removable from the sleeve, wherein the sleeve and the side support are in a fixed position, parallel to a spine of the infant, folding a first end of the wrap around the infant and folding a second end of the wrap around the infant to overlap with the first end of the wrap, connecting the first end and the second end by a first connector on the first end and a second connector on the second end, wherein the first connector and the second connector allow a wrap adjustment to fit a torso circumference of the infant, wherein the side support engages a shoulder of the infant and positions the infant at an acute angle relative to a surface during use of the wrap.

20. The method for treating the orthopedic condition of claim 19, further comprising:

aligning the infant along a placement marker on the wrap.

21. The method for treating the orthopedic condition of claim 19, further comprising:

tightening the sleeve around the side support.

* * * * *